United States Patent [19]

Kuwahara

[11] Patent Number: 4,733,161

[45] Date of Patent: Mar. 22, 1988

[54] CONSTANT CURRENT SOURCE CIRCUIT

[75] Inventor: Hisao Kuwahara, Kamakura, Japan

[73] Assignee: Kabushiki Kaisha Toshiba, Kawasaki, Japan

[21] Appl. No.: 18,475

[22] Filed: Feb. 25, 1987

[30] Foreign Application Priority Data

Feb. 25, 1986 [JP] Japan ..... 61-39535

[51] Int. Cl.[4] ..... G05F 3/20

[52] U.S. Cl. ..... 323/315; 323/316

[58] Field of Search ..... 323/312, 315, 316; 307/296 R, 297

[56] References Cited

U.S. PATENT DOCUMENTS

| | | | |
|---|---|---|---|
| 3,875,430 | 4/1975 | Prak | 323/315 |
| 4,612,496 | 9/1986 | Hines | 323/315 |
| 4,647,840 | 3/1987 | Hiyama | 323/315 |

OTHER PUBLICATIONS

Gray et al., "Analysis and Design of Analog Integrated Circuits," John Wiley & Sons Publication, pp. 200–206 and 236–241, ©1977.

*Primary Examiner*—Peter S. Wong

*Attorney, Agent, or Firm*—Finnegan, Henderson, Farabow, Garrett & Dunner

[57] ABSTRACT

A constant current source circuit for an integrated device having a predetermined power supply voltage. The circuit includes a first current source responsive to the power supply voltage for supplying a first input current to the circuit, a resistor for controlling the level of the output current of the circuit, an output transistor coupled to the resistor for supplying the output current to the resistor and including an emitter having an emitter area, a stabilizing transistor coupled to the output transistor for supplying a fixed voltage to the output transistor in response to the first input current from the first current source, and a stabilizing circuit coupled between the stabilizing transistor and the output transistor for reducing variations in the output current of the circuit without substantially increasing the emitter area of the output transistor.

10 Claims, 6 Drawing Figures

CONSTANT CURRENT SOURCE CIRCUIT

BACKGROUND OF THE INVENTION

1. Field of the Invention

This invention relates to a constant current source circuit, and more particularly, to a constant current source circuit suitable for a bias current supply source of a monolithic integrated circuit (IC).

2. Description of the Prior Art

Constant current source circuits are very useful in integrated circuit (IC) design. Many forms of constant current source circuits have been developed. In constant current source circuits it is required that the operating current of each circuit not be subjected to changes such as undesired current variations (referred as noise signals hereafter), for example, a variation in the power source voltage. Constant current source circuits are also necessary so that the IC can operate at a low power supply voltage and exhibit good power consumption characteristics.

A typical example of a prior art current source circuit is illustrated in a circuit diagram of FIG. 1, which is similar to a circuit shown in "Analysis and Design of Analog Integrated Circuits" by Paul R. Gray and Rober G. Meyer, published by John Wiley & Sons (1977), pp. 200 to 206 and pp. 236 to 241.

As shown, an unstabilized current source 11 has one end connected to a power supply terminal 12 with a voltage Vcc, and the other end connected to the collector of a first transistor 13. The first transistor 13 has an emitter connected to a common power supply end 14 with a ground potential, and a base short-connected to its collector. A second transistor 15 has its base connected to the base of the first transistor 13, its emitter connected to the common power supply end 14 via a resistor 16, and its collector connected to an output terminal 17. A load (not shown) may be connected between the power supply terminal 12 and the output terminal 17, and an output current Iout serving as a load current is then supplied to the load.

The operation of this prior art circuit will now be described. In the circuit of this kind, the collector potential of the first transistor 13 is regulated by the base to emitter voltage Vbe13 of the first transistor 13, since the base of the first transistor 13 is connected to its collector, as described before. Therefore, the first transistor 13 provides a stabilized collector voltage. The base to emitter voltage Vbe13 on the collector of the first transistor 13 is applied to the base of the second transistor 15. On the other hand, the base potential of the second transistor 15 is given a sum of the base to emitter voltage Vbe15 of the second transistor 15 and the voltage drop V16 across the resistor 16. Therefore, a following equation is obtained.

$$V16 = Vbe13 - Vbe15 = \Delta Vbe \quad (1)$$

Here, the difference voltage ΔVbe in the Equation (1) is given as follows.

$$Vbe = (kT/q) \cdot \log n\,(I11/Iout) \cdot N \quad (2)$$
$$= VT \cdot \log n\,(I11/Iout) \cdot N$$

where k is Boltzman's constant;

T is an absolute temperature;

q is the electron charge;

VT (VT=kT/q) is the thermal voltage;

I11 is an input current supplied to the constant current source by the current source 11; and N is an emitter area ratio of the second transistor 15 to the first transistor 13.

If the transistors Q13 and Q15 have large current amplification factors $\beta$13 and $\beta$15, base currents of the transistors Q13 and Q15 can be neglected (this assumption is valid for primary approximation since NPN transistors generally have a current amplification factor $\beta$ of 100 or more). In this condition, the output current Iout can be expressed as follows, $$Iout = \Delta Vbe/R16 \quad (3)$$
$$= (VT/R16) \cdot VT \cdot \log n\,(I11/Iout) \cdot N$$

where R16 is a resistance of the resistor 16.

If the input current I11 is not sufficiently stabilized so that a variation component or a noise current I(n)11 is included in the input current I11 supplied by the current source 11, the constant current source circuit outputs an output noise current I(n) out as follows.

$$I(n)out = I(n)11/[1 + \log n(I11/Iout) \cdot N] \quad (4)$$

As is clear from the Equation (4), the output noise current I(n)out can be reduced by increasing the emitter area ratio N. For example, if the emitter area ratio N is set to a value of 148 (i.e., N=148) and it is intended to obtain an output current Iout equal to the input current I11 supplied by the current source 11, the output noise current I(n)out is given as follows.

$$I(n)out(N;\ 148) = I(n)11/[1 + \log n\ 148] \quad (5)$$
$$= (1/6) \cdot I(n)11$$

That is, the output noise current I(n)out can be reduced to 1/6 of the input noise current I(n)11.

Referring now to FIG. 2, a graph of the reduction rate RN of the output noise current I(n)out to the input noise current I(n)11 is shown as a function of the emitter area ratio N. As seen from FIG. 2, the effect of the noise reduction increases exponentially inproportion to the emitter area ratio N.

In the prior art constant current source, however, it is difficult to increase the emitter area ratio N to a desired sufficiently large ratio, such as the ratio 148. This is because that the second transistor 15 would become too large for practical use. In particular, it is impossible to fabricate a transistor having such a large emitter area on an integrated circuit chip.

SUMMARY OF THE INVENTION

Accordingly, an object of the present invention is to reduce variations of the output current of a constant current source circuit while maintaining a relatively small circuit area.

Another object of the present invention is to provide a constant current source circuit which is able to operate at a relatively low power supply voltage and which exhibits good power consumption characteristics.

In order to achieve the above objects, the constant current source circuit according to the present invention includes a first current course responsive to the power supply voltage for supplying a first input current to the circuit, a resistor for controlling the level of the output current of the circuit, an output transistor coupled to the resistor for supplying the output current to the resistor and including an emitter having an emitter area, a stabilizing transistor coupled to the output transistor for supplying a fixed voltage to the output transistor in response to the first input current from the first current source, and a variation reducing circuit coupled between the stabilizing transistor and the output transistor for reducing variations in the output current of the constant current source circuit without substantially increasing the emitter area of the output transistor.

Additional objects, advantages, and features of the present invention will further become apparent to persons skilled in the art from a study of the following description and of the accompanying drawings, in which:

DESCRIPTION OF THE PREFERRED EMBODIMENT

Figure 1:
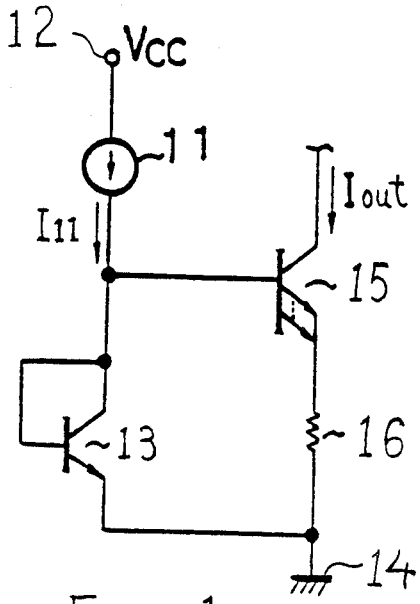
Fig. 1 (Prior Art)
FIG. 1 is a circuit diagram of a constant current source circuit relating to the field of the present invention.
Figure 2:
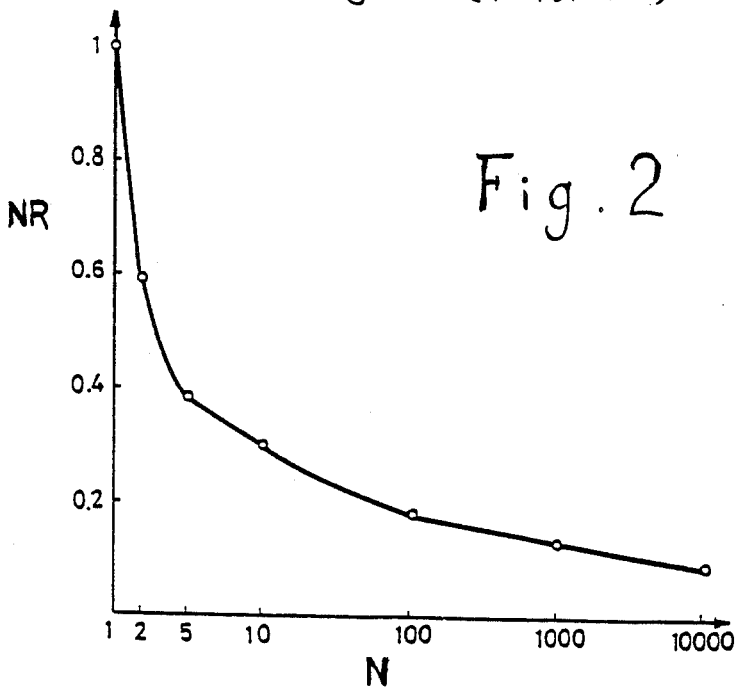
FIG. 2 is a graph showing typical noise reduction rate of the output noise current to the input noise current of the circuit in FIG. 1.

The present invention will now be described in detail with reference to the accompanying drawings, namely, FIG. 3 to FIG. 6. Throughout the drawings, like reference numerals and letters are used to designate elements like or equivalent to those used in FIG. 1 for the sake of simplicity of explanation.

Figures 3, 4:
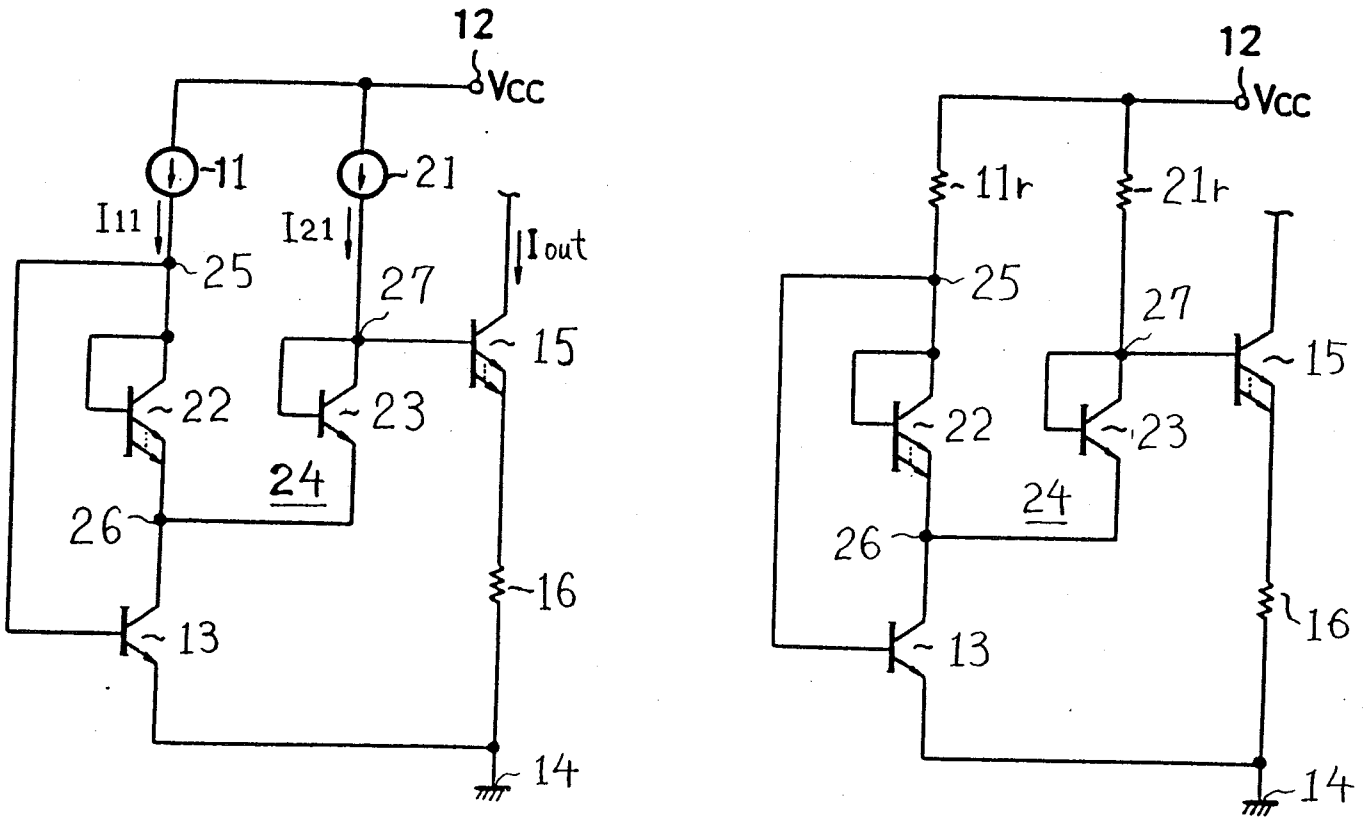
FIG. 3 is a circuit diagram showing a first embodiment of the constant current source circuit of the invention.
FIGS. 4 and 5 are circuit diagrams of modified examples of the first embodiment.

Referring now to FIG. 3, a first embodiment of the constant constant source circuit according to the present invention will be described in detail. The constant constant source circuit of FIG. 3 is comprised of first and second current sources 11 and 21, first to fourth transistors 13, 15, 22 and 23 and a resistor 16. The first current source 11 has one end connected to a power supply terminal 12 with a voltage Vcc, and the other end connected to the collector of the first transistor 13 through the third transistor 22. The first transistor 13 has an emittr connected to a common power supply end 14 with a ground potential, and a base connected to the first current source 11, as described later. The second transistor 15 has its base connected to the base of the first transistor 13 through the fourth transistor 23, its emitter connected to the common power supply end 14 via the resistor 16, and its collector connected to an output terminal 17. A load (not shown) may be connected between the power supply terminal 12 and the output terminal 17, and an output current Iout serving as a load current is then supplied to the load.

The second current source 21, the third transistor 22 and the fourth transistor 23 form a circuit 24 together for reducing a variation in the output current Iout. The third transistor 22 in the reducing circuit 24 has its emitter connected to the collector of the first transistor 13, and its base short-connected to its collector. Then, the base of the first transistor 13 is connected to a connection node 25 of the first current source 11 and the collector of the third transistor 22. The second current source 21 has one end connected to the power supply terminal 12 and the other end connected to the collector of the fourth transistor 23. The fourth transistor 23 has its emitter connected to a connection node 26 of the emitter of the third transistor 22 and the collector of the first transistor 13, and its base short-connected to its collector. Then the base of the second transistor 15 is connected to a connection node 27 of the second current source 21.

The operation of the first embodiment of the constant current source circuit will now be described. The collector potential of the first transistor 13 is regulated by the base to emitter voltage Vbe13 of the first transistor 13, since the base of the first transistor 13 is connected to its collector, as described before. Therefore, the first transistor 13 provides a stabilized collector voltage. On the other hand, the first and second current sources 11 and 21 supply first and secons input current I11 and I21 in the constant curreent source circuit, respectively. Here it is assumed that the second current source 21 supplies the second input current I21 which is M times of the first input current I11 of the first current source 11. Then the first and second input currents I11 and I21 of the first and second current sources 11 and 21 have a relation as follows.

$$I11:I21=1:M \tag{6}$$

Thus, a current I13 flowing through the first transistor 13 is obtained as follows.

$$I13=I11+I21=(1+M)\cdot I11 \tag{7}$$

Further it is assumed that the third transistor 22 has an emitter area which is N1 times of that of the first transistor 13. Thus, the current density in the emitter of the third transistor 22 is smaller than that of the first transistor 13 by 1/N1 times. Accordingly, the base to emitter voltage Vbe22 of the third transistor 22 is decreased in comparison to the base to emitter voltage Vbe13 of the first transistor 13. Therefore, the base to emitter voltages Vbe13 and Vbe22 of the first and third transistors 13 and 22 have following equations, respectively.

$$Vbe13 = VT \cdot \log n\, I13/Is \tag{8}$$

$$= VT \cdot \log n\, [(1 + M) \cdot I11]/Is$$

$$Vbe22 = VT \cdot \log n\, I22/Is \tag{9}$$

$$= VT \cdot \log n\, I11/(N1 \cdot Is)$$

where Is is the reverse saturation current of the transistors.

A potential on the connection node 26 of the emitter of the third transistor 22 and the collector of the first transistor 13 is given by the voltage difference between the base to emitter voltages Vbe13 and Vbe22 of the first and third transistors 13 and 22, and it is equivalent to the emitter potential Ve23 of the fourth transistor 23. Thus, the emitter potential Ve23 of the fourth transistor 23 may be represented as follows.

$$Ve23 = Vbe13 - Vbe22 \tag{10}$$

-continued $$= VT \cdot \log n\,[(1 + M) \cdot I11]/Is - VT \cdot \log n\, I11/(N1 \cdot Is)$$

$$= VT \cdot \log n\,(1 + M) \cdot N1$$

On the other hand, the potential on the connection node 27 of the second current source 21 and the collector of the fourth transistor 23 is given by the sum of the emitter potential Ve23 of the fourth transistor 23 and the base to emitter voltage Vbe23 of the fourth transistor 23, and it is equivalent to the base potential Vb15 of the second transistor 15. Thus, the base potential Vb15 of the second transistor 15 may be given as follows.

$$Vb15 = Vbe23 + Ve23 \quad (11)$$

$$= VT \cdot \log n\, I21/Is + VT \cdot \log n\,(1 + M) \cdot N1$$

$$= VT \cdot \log n\, M\, I11/Is + VT \cdot \log n\,(1 + M) \cdot N1$$

$$= VT \cdot \log n\,[M\,(1 + M) \cdot N1 \cdot I11]/Is$$

Here, it is assumed that the second transistor 15 has an emitter area which is N2 times of that of the fourth transistor 23. Thus, the current density in the emitter of the second transistor 22 is smaller than that of the fourth transistor 23 by 1/N2 times. Accordingly, the base to emitter voltage Vbe15 of the second transistor 15 is decreased in comparison to the base to emitter voltage Vbe23 of the fourth transistor 23. Therefore, the base to emitter voltage Vbe15 of the second transistor 15 is given as follows.

$$Vbe15 = VT \cdot \log n\, Iout/(N2 \cdot Is) \quad (12)$$

From the Equations (11) and (12), the voltage V16 across the resistor R16 is expressed as follows.

$$V16 = Vb15 - Vbe15 \quad (13)$$

$$= VT \cdot \log n\,[M \cdot (1 + M) \cdot N1 \cdot I11]/Is - VT \cdot \log n\, Iout/(N2 \cdot Is)$$

$$= VT \cdot \log n\,[M \cdot (1 + M) \cdot N1 \cdot N2 \cdot I11]/Iout$$

Here, the output current Iout is controlled by the resistance R16 of the resistor 16. When it is intended to obtain the output current Iout equivalent to the second input current I21, the above Equation (12) is changed as follows.

$$Vbe15 = VT \cdot \log n\,(M \cdot I11)/(N2 \cdot Is) \quad (14)$$

From the Equations (11) and (14), the voltage V16 across the resistor R16 is expressed as follows.

$$V16 = Vb15 - Vbe15 \quad (15)$$

$$= VT \cdot \log n\,[M \cdot (1 + M) \cdot I11]/Is - VT \cdot \log n\,(M \cdot I11)/(N2 \cdot Is)$$

$$= VT \cdot \log n\,(1 + M) \cdot N1 \cdot N2$$

If noise currents I(n)11 and I(n)21 are included in the unstabilized input currents I11 and I21 of the first and second current sources 11 and 21, the noise currents I(n)11 and I(n)21 have a following relation between them.

$$I(n)11 : I(n)21 = 1 : M \quad (16)$$

Therefore, the noise current I(n)out in the ouput current Iout is given by a following equation.

$$I(n)out = I(n)21/(1 + V16/VT) \quad (17)$$

$$= I(n)21/[1 + \log n\,(1 + M) \cdot N1 \cdot N2]$$

From the Equation (17), it is easily understood that the noise current I(n)out is reduced to 1/6 that of input constant current I11, by setting a value of the term [(1+M)·N1·N2] to about 148. The value 148 of the term [(1+M)·N1·N2] is obtained by setting, for example, N1=5, N2=5 and M=5. Accordingly, the first embodiment of the constant current source circuit according to the present invention can is fabricated on IC chips with an area of only 12 times that of a unit emitter area. This compares with an area of about 149 times with the circuit of FIG. 1. Thus, a large amount of reduction of the noise current in the output cuurent may be easily realized without sacrificing space in the IC chips.

Further, in the first embodiment of the constant current source circuit, the first current source 11 is coupled to the common power supply end 14 through only single base-emitter junction of the first transistor 13. Therefore, the constant current source circuit according to the present invention can be driven by the power supply source 12 with a relatively low voltage. Thus, the constant current source circuit has a very low power consumption.

Referring now to FIG. 4, a modification of the first embodiment of the constant current source circuit will be described. FIG. 4 differs from FIG. 3 only with respect to the first and second current sources 11 and 21, which are replaced in FIG. 4 by resistors 11*r* and 21*r* with relatively large resistances. Therefore, the modification of the first embodiment of the constant current source circuit shown in FIG. 4 also can output a stable constant current while maintaining a relatively small IC chips area.

Figure 5:
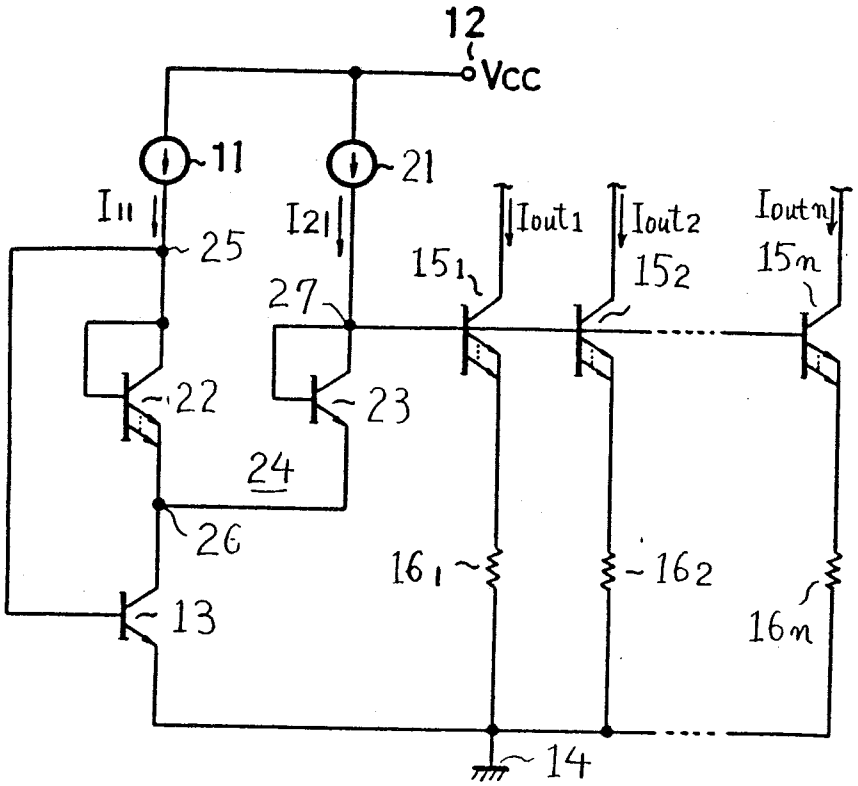

Referring now to FIG. 5, another modification of the first embodiment of the constant current source circuit will be described. FIG. 5 differs from FIG. 3 only in the use of a plurality of current output circuits, instead of a single output circuit. The plurality of current output circuits each includes a transistor 151, 152, . . . , or 15*n* corresponding to the second transistor 15 in FIG. 3, and a resistor 161, 162, . . . , or 16*n* corresponding to the resistor 16 in FIG. 3. The transistor and resistor of each current output circuit are connected to the fourth transistor 23 in the current mirror fashion. Therefore, this modification of the first embodiment of the constant current source circuit can output a plurality of constant currents. The constant currents are independently set by the resistances of the resistors 161, 162, . . . , and 16*n*.

Figure 6:
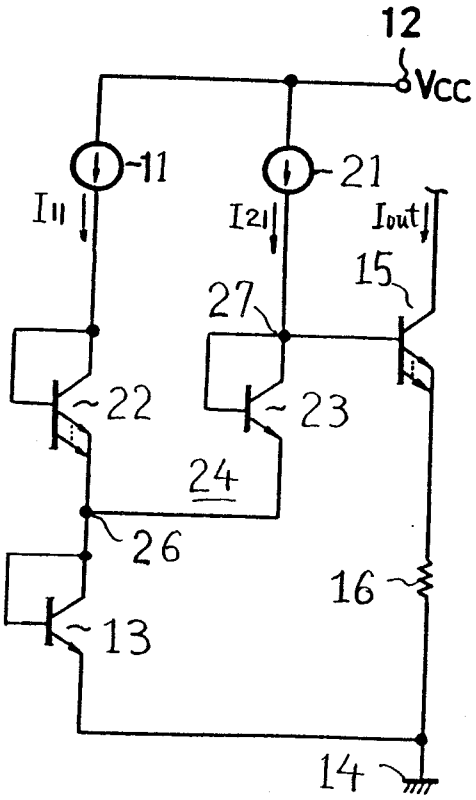
FIG. 6 is a circuit diagram showing a second embodiment of the constant current source circuit of the present invention.

Referring now to FIG. 6, a second embodiment of the constant current source circuit will be described. The only difference between FIG. 6 and FIG. 3 is that the first transistor is short-connected at its base to its collector. In the second embodiment of the constant current source circuit, the first current source 11 is coupled to the common power supply end 14 through the series of two base-emitter junctions of the third and first transistors 22 and 13. Therefore, the circuit is driven by the power supply source 12 with a relatively high voltage, in compared to FIG. 3. Thus, the circuit has a relatively high power consumption. However, the second embodiment of the constant current source circuit has the same ability in respect to the stabilization of the output current.

According to the above embodiments, the constant current source circuit of the present invention is able to provide a very stable current without excessively increasing size of the circuit area on IC chips, in compared to conventional circuit.

Although the present invention has fully been described in connection with the preferred embodiment thereof with reference to the accompanying drawings, it is to be noted that various changes and modifications are apparent to those skilled in the art. Such changes and modifications are to be understood as included within the scope of this invention unless they depart therefrom.

What is claimed is:

1. A constant current source circuit for an integrated device having a predetermined power supply voltage, comprising:

first current source means responsive to the power supply voltage for supplying a first input current to the circuit;

resistor means for controlling the level of the output current of the circuit;

output transistor means coupled to the resistor means for supplying the output current to the resistor means, including an emitter having an emitter area;

stabilizing transistor means coupled to the output transistor means for supplying a fixed voltage to the output transistor means in response to the first input current from the first current source means; and means coupled between the stabilizing transistor means and the output transistor means for reducing variations in the output current of the circuit without substantially increasing the emitter area of the output transistor means.

2. The circuit of claim 1 wherein the reducing means includes second curent source means responsive to the power supply voltage and connected in parallel with the first current source means, for supplying a second input current to the circuit.

3. The circuit of claim 2 wherein the reducing means also includes a first reducing transistor coupled in series between the first current source means and the stabilizing transistor means, and a second reducing transistor coupled in series between the second current source means and the stabilizing transistor means.

4. The circuit of claim 3 wherein the stabilizing transistor means includes a stabilizing transistor having its base-emitter junction coupled in series with the first current source means for maintaining the power supply voltage of the circuit at a relatively low level.

5. The circuit of claim 4 wherein the first reducing transistor has its collector coupled to the first current source means, its base short-coupled to its collector and its emitter coupled to the stabilizing transistor.

6. The circuit of claim 5 wherein the first reducing transistor has its base-emitter junction larger than the base-emitter junction of the stabilizing transistor.

7. The circuit of claim 4 wherein the second reducing transistor has its collector coupled to the second current source means, its base short-coupled to its collector and its emitter coupled to the stabilizing transistor.

8. The circuit of claim 7 wherein the output transistor means has its base-emitter junction larger than the base-emitter junction of the second reducing transistor.

9. The circuit of claim 4 wherein the second current source means supplies the second input current larger than the first input current supplied from the first current source means.

10. The circuit of claim 4 wherein the first reducing transistor has its base-emitter junction larger than the base-emitter junction of the stabilizing transistor, the second reducing transistor has its collector coupled to the second current source means, its base short-coupled to its collector and its emitter coupled to the stabilizing transistor, and the second current source means supplies the second input current larger than the first input current supplied from the first current source means.

* * * * *